US007453033B2

(12) United States Patent
Redard

(10) Patent No.: US 7,453,033 B2
(45) Date of Patent: Nov. 18, 2008

(54) DETACHABLE TOP PICKUP FOR MUSICAL STRINGED INSTRUMENTS

(76) Inventor: Charlie Gordon Redard, 5852 Los Ranchos Dr., Buena Park, CA (US) 90620

( * ) Notice: Subject to any disclaimer, the term of this patent is extended or adjusted under 35 U.S.C. 154(b) by 0 days.

(21) Appl. No.: 11/653,689

(22) Filed: Jan. 16, 2007

(65) Prior Publication Data

US 2008/0168884 A1 Jul. 17, 2008

(51) Int. Cl.
*G10C 3/04* (2006.01)

(52) U.S. Cl. ..... 84/214; 84/213

(58) Field of Classification Search ..... None
See application file for complete search history.

(56) References Cited

U.S. PATENT DOCUMENTS

| | | | | | |
|---|---|---|---|---|---|
| 3,159,713 | A * | 12/1964 | Laube, Jr. | ..... | 381/65 |
| 4,168,647 | A * | 9/1979 | Petillo | ..... | 84/731 |
| 4,501,186 | A * | 2/1985 | Ikuma | ..... | 84/726 |
| 7,015,390 | B1 * | 3/2006 | Rogers | ..... | 84/723 |
| 2006/0054009 | A1 * | 3/2006 | Redard | ..... | 84/723 |

* cited by examiner

*Primary Examiner*—Marlon T Fletcher
(74) *Attorney, Agent, or Firm*—Mario Erlinda Co Sarno

(57) ABSTRACT

A detachable and portable top pickup for a musical stringed instrument, comprising a clamp having an open end for attaching a top pickup on a pickup holder to a section of a guitar and a connector coupling the top pickup to an elongated bar, the connector allowing the top pickup to slide along the length of the elongated bar. A second clamp can be used to attach to another section of the guitar to get a stronger and more balanced hold for the top pickup. The clamps allow the top pickup to be removed, transferred or reinstalled without causing any damage on the surface of the guitar.

20 Claims, 9 Drawing Sheets

DETACHABLE TOP PICKUP FOR MUSICAL STRINGED INSTRUMENTS

BACKGROUND

This invention relates to a detachable, removable and portable top pickup that can be incorporated into existing musical stringed instruments such as acoustic and electric guitars, violins, basses, and the like, herein collectively referred to simply as guitar. Musical stringed instrument and guitar, herein are used interchangeably to mean the same thing. The usage of pickups for musical instruments are known. A majority of these pickups convert acoustic energy from the vibrations of the strings into electric energy which is electromagnetically amplified. Present top pickups are permanently installed into the musical instruments or instead have holders or mountings that are permanently installed. These can not be easily removed at will from the guitar. Further, removal of the top pickup or its holder from the guitar leaves at least a hole or an opening bored on the main body of the guitar when the pickup holder or the tracks where a top pickup slides from is removed. Boring an opening or doing other physical structural modifications on the guitar to install a top pickup into an existing musical instrument is not attractive to most guitar owners especially owners of expensive guitars. They are not willing to structurally modify the guitar in order to install a pickup. Consequently, they buy several guitars with pickups, if needed. Pickups that can be detached are usually a part of an entire neck section of the guitar and it is the neck section that is detachable and not the pickup as shown in U.S. Pat. No. 5,929,362. The pickup here also is for a bottom and not for a top pickup. The pickup just goes along with the entire neck. Also, being a part of a neck section, this pickup is specially catered to a particular guitar and can not be attached to another guitar constructed or designed differently. U.S. Pat. No. 5,929,362 issued to the same inventor and applicant discloses a musical stringed instrument with different types of top and/or bottom pickups: a top pickup that can swing in and out of a zone of the string vibration; a top pickup in combination with a slidable bottom pickup; a permanent or slidable top pickup in combination with a permanent or slidable bottom pickup; and, a slidable top pickup. Although the description of the top pickup was described as removable in the above patent, it only means that the top pickup can be removed from the zone of the string vibration. When the pickup is removed, as mentioned above, they do not leave an intact guitar, but rather, a guitar with some structural changes due to the mounting of the pickups especially the top pickup because this is located on top of the strings at the front panel of the guitar with the transducers of the top pickup facing the strings.

It is therefore an object of this invention to provide a top pickup that can be repeatedly removed and reinstalled in any guitar without causing any structural modification or damage on the guitar.

It is also an object of this invention to provide a detachable and portable top pickup that can be installed in any guitar or guitars of varying designs.

It is a further object of this invention to provide a detachable and portable sliding top pickup on top of a string or a plurality of strings of a musical instruments.

It is also a further object of this invention to provide a detachable and portable top pickup that can swing into and out of a zone of the string vibration or tone detection.

SUMMARY OF THE INVENTION

This invention relates to a detachable and portable top pickup for a musical stringed instrument, comprising: a clamp having an open end for attaching a top pickup on a pickup holder to a section of a guitar; a connector coupling the top pickup to an elongated bar, the connector allowing the top pickup to slide along the length of the elongated bar; and, means for attaching the clamp and the connector to the elongated bar. The detachable top pickup is recommended to have a second clamp having an open end for attaching the top pickup to a different section of the guitar. The second clamp comprises a pair of exterior plates joined by a bar at one common lateral bottom end of the plates to form a C shape; a pair of inside plates separated by two spring enveloped bars connected to the exterior plates at an interior section of the clamp, the pair of inside plates lined on the surface facing the interior of the clamp with a scratch preventing material; and, two pairs of adjusting screws for pushing the pair of inside plates towards a surface of the guitar. The first clamp is simpler, it comprises a pair of outside borders connected to a bottom closed end forming a shape of a C; a pair of inside strips separated by a spring enveloped bar at an interior section of the clamp, the pair of inside strips lined on the surface facing the interior of the clamp with a scratch preventing material; and, a pair of adjusting screws for pushing the pair of inside strips towards a surface of the guitar. Te open end of both clamps is wider than the thickness of an ordinary guitar to cater to variations in width of the different guitars as well as provide some flexibility in the positioning of the guitar. This also allows varying the distance between the top pickup and the strings. The screws used here are designed to be tightened and loosened by hand to avoid the, need of instruments like a screw driver and the like. The adjusting screw has a head with a roughened surface at one end and another end opposite the head abutting a surface of the inside strip facing the outside border. The elongated bar can be solid or hollow. The connector has a locking mechanism for restraining and releasing the top pickup. It is recommended for the locking mechanism to have a trigger that the player can easily touch while playing to allow the player to easily release the top pickup and move this to another desired direction or to remove the top pickup out of the zone of the string vibration as needed. There are times or there could be guitars due to their design, where swinging the top pickup away from the zone of string vibration is not enough to totally remove any sound or tone coming from the top pickup. It is therefore recommended to have a connector that will also withdraw the top pick up as far as possible from the strings. One option is to have a connector that has a flip holder allowing the top pickup to be raised in a vertical position away from a zone of string vibration. To get the top pickup out of the way after being raised, a pivot pin can be used to attach the top pickup to the connector because the pivot pin can then let the top pickup swing on the side in a position aligned along the length of the guitar. The pivot pin also allows the top pickup to swing into, partially into or out of a zone of string vibration. The desired span of swing is usually over approximately a hundred eighty degree on a vertical or horizontal position. As used here, the top pickup is in a horizontal position when it is situated on top of and/or parallel to the strings and it is in a vertical position when it is upright away from the strings and on the same plane, side by side with the guitar . A distance is kept between the top pickup and the pickup holder by a spring enveloped screw having the spring enveloping only that portion of the screw between the top pickup and the pickup holder. The spring enveloped screw narrows or widens the distance between the top pickup and the pickup holder which consequently affect the distance of the top pickup from the strings. The number of spring enveloped screws is dependent upon the desire of the manufacturer. The detachable and portable top pickup can be made of metal or plastic.

DETAILED DESCRIPTION OF THE INVENTION

Figure 1:
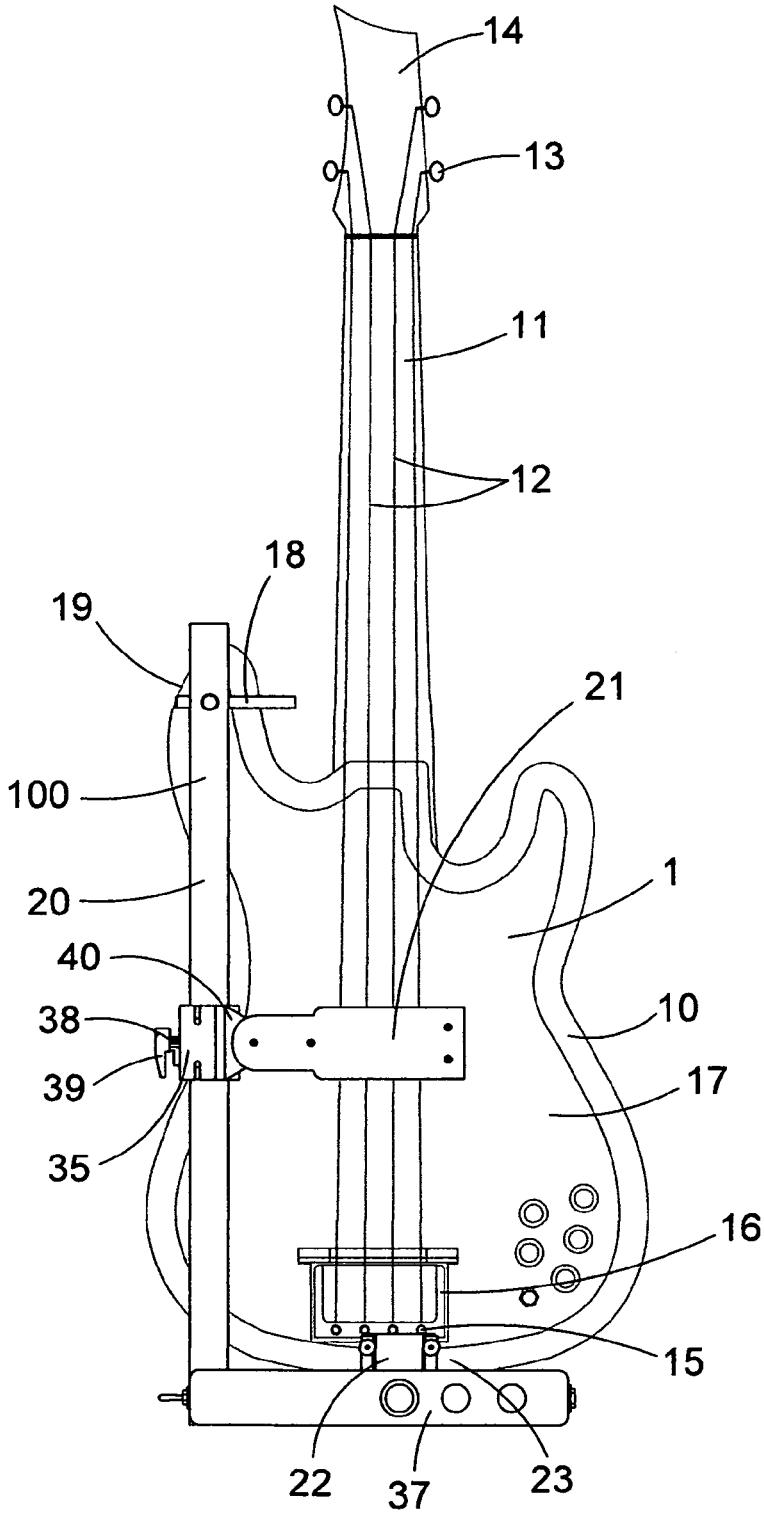
FIG. 1 is a front view of a guitar having a detachable top pickup assembly.
Figure 3A:
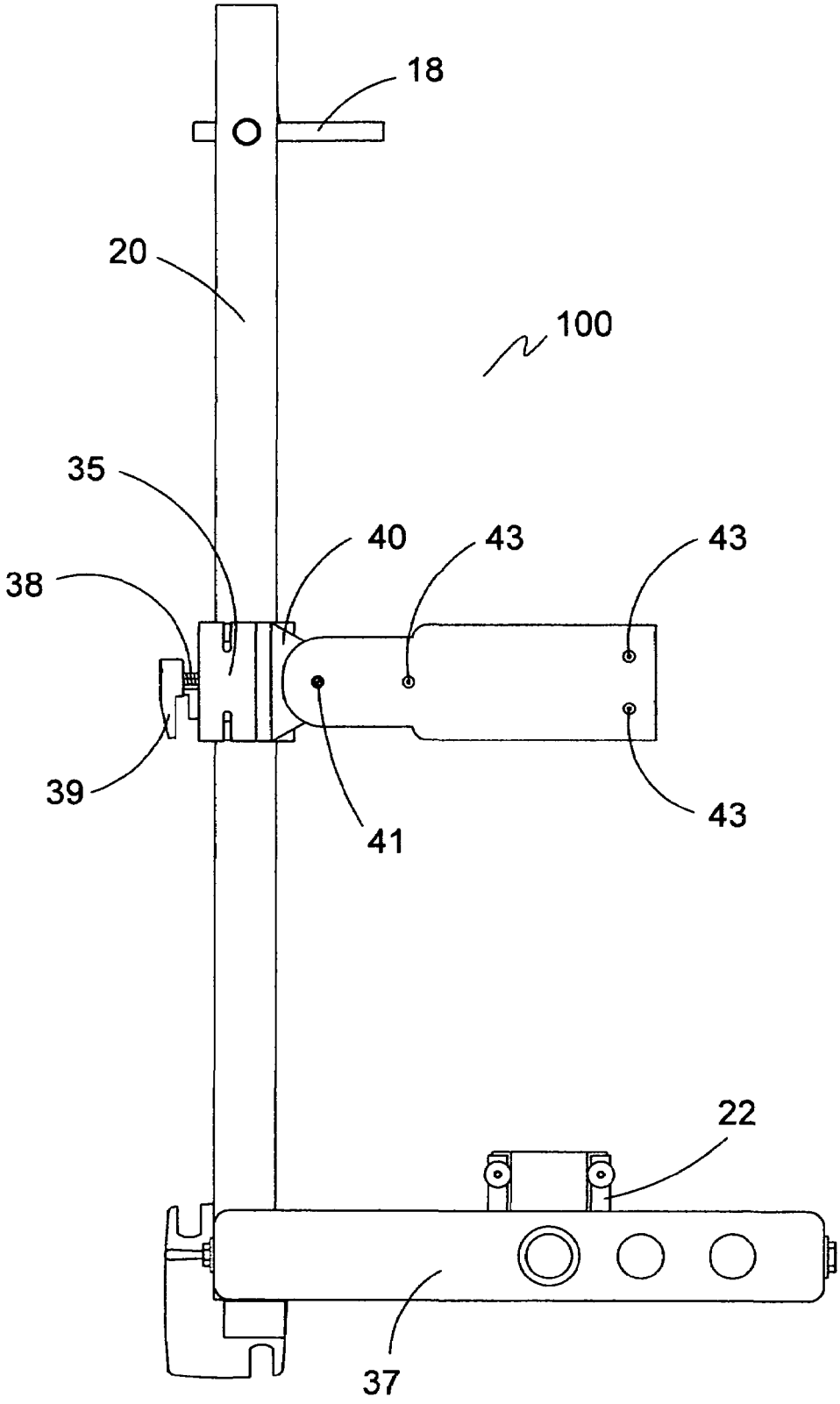
FIG. 3A is a front view of a detachable top pickup assembly without a guitar.

The detailed description represented herein is not intended to represent the only way or the only embodiment in which the claimed invention may be practiced. The description herein is provided merely as an example or examples or illustrations of the claimed invention and should not be construed as the only way or as the preferred or advantageous over other embodiments or means of practicing the invention. The detailed description includes specific details to provide a thorough understanding of the claimed invention and it is apparent to those skilled in the art that the claimed invention may be practiced without these specific details. In some instances, well known structures and devices are shown in block diagrams or drawn with broken lines in order to avoid obscuring the main concepts of the invention. FIG. 1 and 3A show a detachable and portable top pickup assembly 100. FIG. 1 shows the top pickup assembly 100 with a guitar 1 while FIG. 3A shows the top pickup assembly 100 without a guitar 1. The core of this claimed invention is to utilize a clamp or a plurality of clamps for attaching a top pickup to a guitar. With the use of a clamp, a top pickup can simply be detached from a guitar without causing any structural changes on the guitar and this type of connection also allows one top pickup to be used with different guitars, thereby reducing the cost of buying several types of guitars with their own top pickups.

Figure 2:
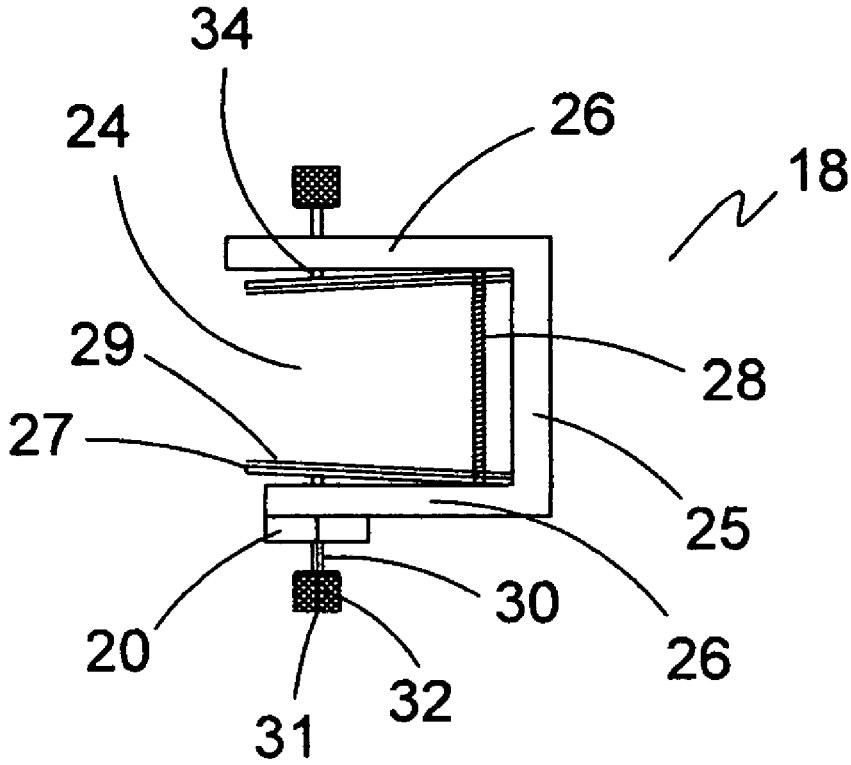
FIG. 2 is a side view of the top clamp at the top pickup assembly viewed from the top of a guitar.

A typical guitar 1 includes a solid or hollow body 10 and a neck 11 secured to one end of the body 10. The neck supports a string or a series of strings 12 which extends from a first anchoring element 13 at the neck 11 or headstock 14 of the guitar to a second anchoring element 15 of a bridge 16 of the guitar. The bridge is located near the bottom of the front panel 17 of the body 10 as shown in FIG. 1. The assembly for facilitating fixation and tightening of the strings with respect to the body and/or neck of the guitar are variably design and is not part of the claimed invention. The strings correspond to the musical notes. The first 13 and second 15 anchoring elements are critical contact surfaces because it determines the length of the string/s 12 and the latter affects the frequency of the tone produced by the guitar, that is, the distance between the two contact surfaces define the harmonic length of the string. An example of a top pickup assembly 100 shown here comprises a top clamp 18 for holding a top side section 19 of a guitar; a side bar or shaft 20 for holding a top pickup 21; a bottom clamp 22 for holding a mid bottom section 23 of the guitar; and, the electrical circuits and accessories for supporting the operation of the top pickup and the guitar proper. The top clamp 18 shown in FIG. 2 as an example is typically a C-clamp. Other clamps of similar function can be used. As shown, the open end 24 of the C-clamp where the top side section of the guitar is inserted into faces away from the neck 11 or strings 12 of the guitar. The closed end 25 of the C-clamp may be straight or curved to cater to the outside contour of the guitar. The C-clamp 18 has a pair of outside borders 26 connected at the bottom to form the closed end 25. The outside borders 26 and the closed end 25 can come as a single piece. Within the outside border at the interior section of the C-clamp is a pair of inside strips 27 separated by a spring enveloped bar 28 connected to the outside borders located near the closed end 25 of the C-clamp 18. The pair of inside strips 27 are lined on the surface facing the interior of the C-clamp with a rubber or other scratch preventing materials 29, hereinafter lining 29, to avoid scratching the surface of the top side section of the guitar when the detachable top pickup assembly 100 is attached to the guitar. The inside strips 27 of the top C-clamp 18 abuts on the surface of the top side section of the guitar by a pair of adjusting screws 30 introduced into a bored through opening (not shown) on the outside border 26 of the C-clamp 18 proximal to the open end 24 pushing the inside strips towards the surface of the guitar. The adjusting screw 30 has a head 31 with a roughened surface 32 at one end to provide a gripping surface for the fingers as they turn the screw. The other end 34 opposite the head 31 abuts on the surface of the inside strip 27 facing the outside border. As the screw is turned towards the inside strip, the end 34 causes the lining 29 on the pair of inside strips to abut a top side section 19 of the guitar. A spring enveloped bar 28 connected to the outside border 26 proximal to the closed end 25 prevents the pair of inside strips from collapsing towards each other when not in use; prevents inadvertent over tightening of the pair of inside strips after a top side section of the guitar is inserted into the open end 24 of the C-clamp 18; and, causes the inside strips 27 to assume a straight position after abutting on the surface of the guitar because the spring located between the inside surfaces of the inside strips compresses or loosens up according to the distance between the inside strips to keep both strips pressing on the surface of the guitar. The open end 24 of the C-clamp 18 is recommended to be wider than the thickness of an ordinary guitar. A width that is about 1.25 times the thickness will allow the flexibility of controlling the location and position of the guitar by positioning the inside strips to abut at the surface of the guitars at the desired location or position. The location and position of the guitar, consequently affects the distance between the top pickup and the strings. Positioning of the inside strips within the outside borders narrows the width of the open end 24.

Figure 3B:
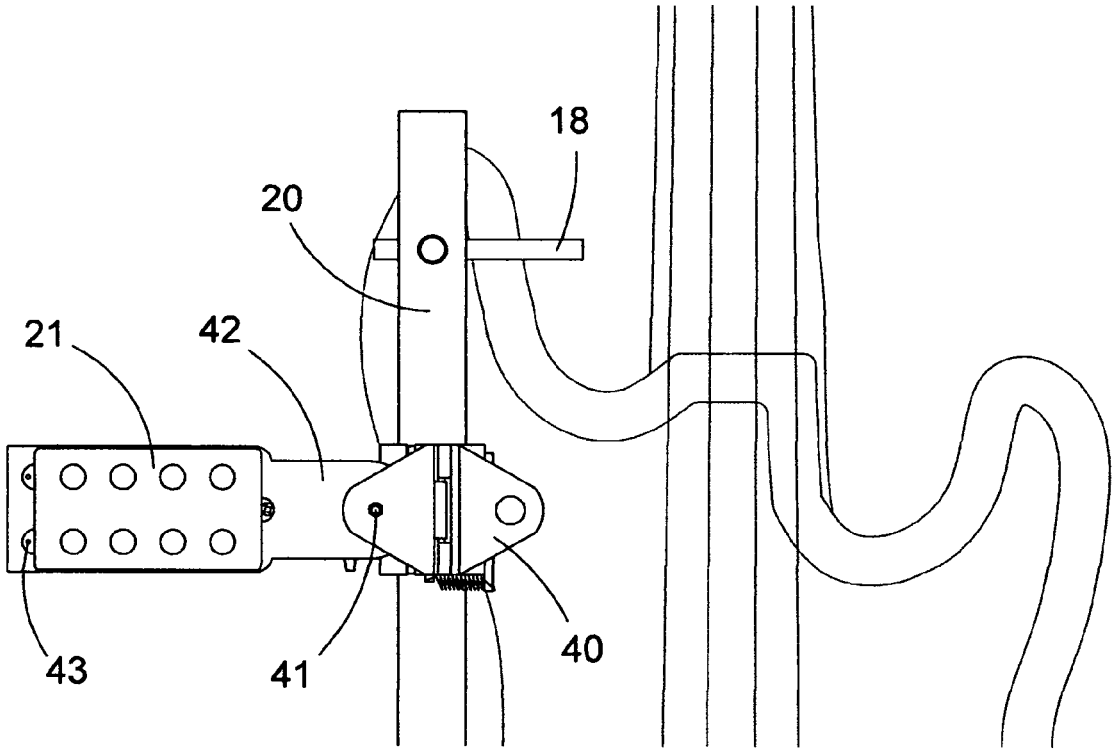
FIG. 3B is a perspective view of a top pick up after being lifted up from the zone of the string vibration.
Figure 3C:
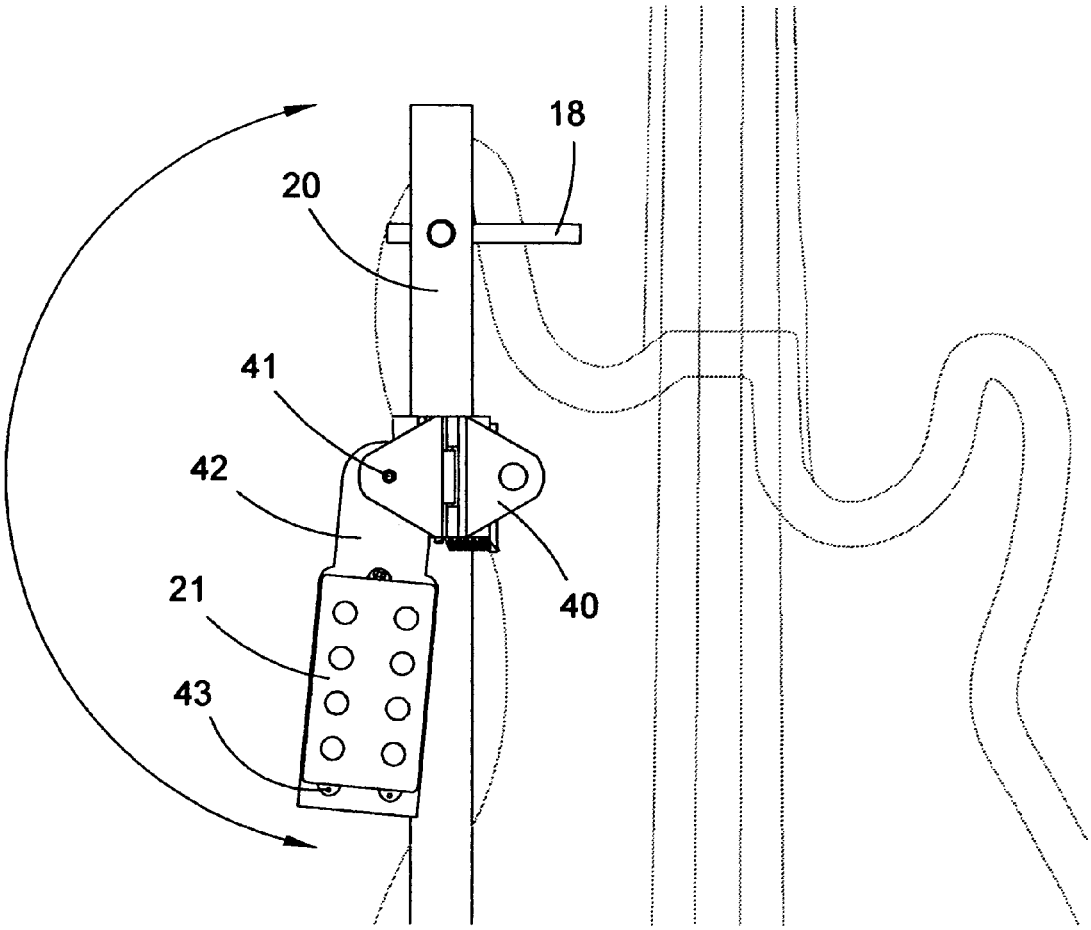
FIG. 3C is a perspective view of a top pickup after being lifted up from the zone of the string vibration and then placed on either side of the bar holding the pickup to maximize the distance away from the string's vibration.
Figure 3D:
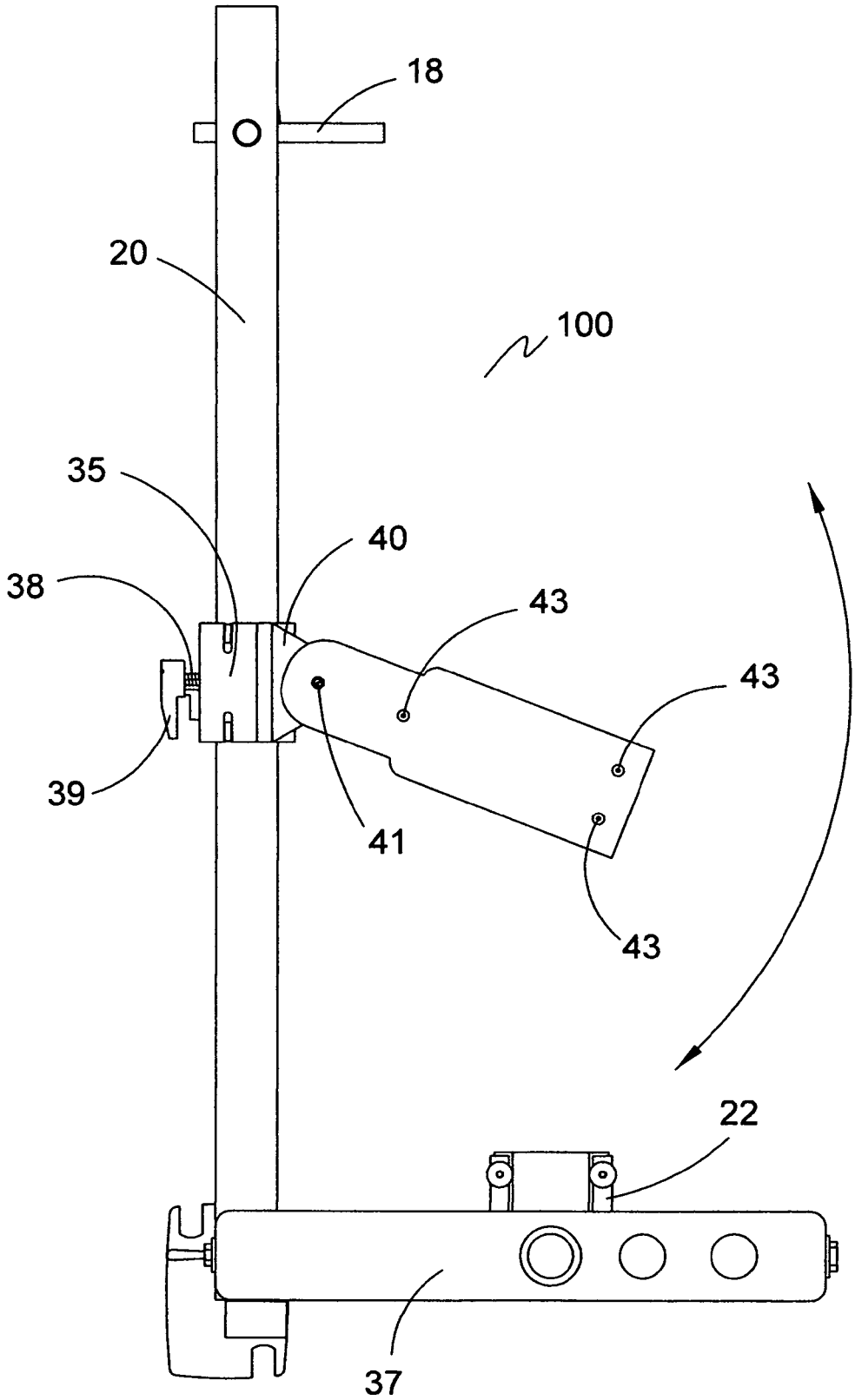
FIG. 3D is FIG. 3A showing the direction of the detachable top pickup when it swings into, partially into or out of the zone of the string vibration.

As shown in FIG. 1, the top pickup 21 is coupled to an elongated shaft or bar 20, hereinafter also simply referred to as bar, with a connector 35 that would allow the top pickup 21 to slide along the length of the string by sliding along the length of the shaft or bar 20. The bar can be solid or hollow. It can be any elongated object so long as it will support the top pickup and allow this to slide on top of the strings along a given workable distance. Since the electrical wiring (not shown) connecting the top pickup with the electrical circuitry of the guitar also slides along with the top pickup, it is recommended to have a wiring which self adjusts its length according to the distance between the top pickup and the input 36 (best seen at FIGS. 5 and 5A) at the electrical control box 37 of the guitar. This is usually achieved by winding the electrical wiring on a reel that automatically lengthens or shortens the wiring according to the tension (push or pull) applied on the electrical wiring. These reels are commercially available. The connector 35 is recommended to have a locking mechanism 38 to restrain or keep the top pickup from inadvertently sliding out of a desired position along the length of the strings when in use. However, this locking mechanism should also easily release the top pickup. The top pickup is changed in position along the bar 20 by pressing the trigger 39 of the locking mechanism to release the top pickup and simultaneously slide the top pickup to another desired location. The connector 35 has a flip holder 40 where the top pickup rests as shown in FIGS. 3A-C. The flip holder 40 allows the top pickup 21 to be raised in a vertical position away from the zone of the string vibration through a hinge as shown in FIG. 3B and then placed on either side of the bar 20 through a pivot pin 41 as shown in FIG. 3C, according to the discretion of the player. This will further remove the top pickup from the zone of string vibration and also keep the top pickup 21 from obstructing the player when not in use. It is actually a pickup holder 42 that attaches to the flip holder 40 by the pivot pin 41 in this example. The pickup holder holds the pick up. The pivot pin 41 also allows the top pickup to swing into, partially into or out of the zone of string vibration at a horizontal position above the front panel and consequently the string of a guitar as shown in FIG. 3D. Alternatives to a pivot pin can be used so long as it allows the top pickup to pivot to a desired location or position. Reference to the pickup herein also includes the pickup holder, if used but not specifically mentioned.

Figure 4A:
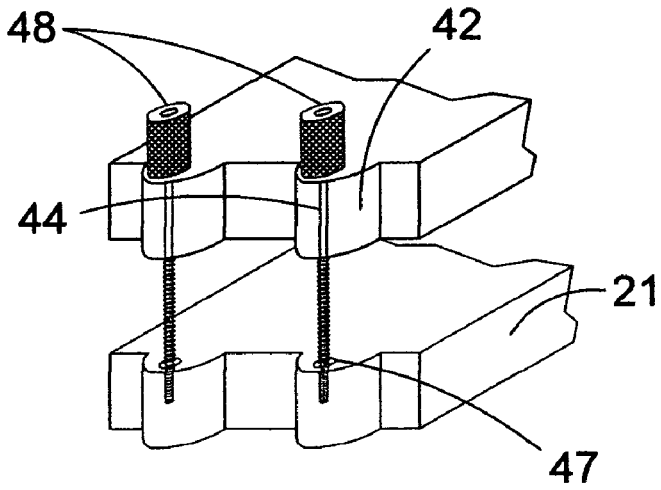
FIG. 4A shows the attachment of the pickup holder with the pickup using the screw shown in FIG.4
Figure 4:
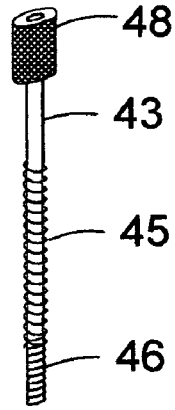
FIG. 4 is an example of a screw for attaching a pickup to a pickup holder.

There is a distance kept between the pickup holder 42 and the pickup 21 by the use of a special screw 43 introduced into the pickup holder through an opening 44 drilled through the top surface of the pick up holder. A description of this type of screw and the connection between the pickup holder and the pickup is described in column 5 and FIGS. 4 and 4A of the U.S. Pat. No. 7,145,063B issued to the applicant. This type of screw has portions with and without a spring as shown in FIG. 4. The portion of the screw without a spring 45 rests on the opening 44 of the pickup holder 42 as shown in FIGS. 4 and 4A. This screw protrudes beyond the height or thickness of the pickup holder. At the protruding end, the spring 45 is introduced and will occupy the space or distance between the pickup and the pickup holder. The spring envelopes this portion of the screw 43 between the pickup and the pickup holder. This screw 43 is also referred to herein as spring enveloped screw 43. The bottom end 46 of the spring enveloped screw 43 is in turn inserted into a matching opening 47 at the surface of the top pickup directly opposite the opening 44 of the pickup holder. The opening 47 does not go all the way through the thickness of the top pickup but only at a depth enough to accommodate and secure the spring enveloped screw 43. The opening 47 is preferably threaded to be able to control the. distance or length of the bottom end 46 of screw 43 going inside the opening which is also preferably correspondingly threaded. The bottom end 46 of the screw 43 going inside opening 47 does not have a spring. The turn diameter of the spring 45 is larger than both openings 44 and 47 and therefore stays between the pickup and the pickup holder. The length of the spring 45 covers the distance between the pickup and the pickup holder. This type of attachment allows fine adjustments on the distance between the pickup holder and the pickup which consequently adjusts the distance between the strings 12 and the top pickup 21. The distance between the strings and the top pickup affects the tone produced by the guitar. The spring enveloped screw 43 used herein has a head 48 with a roughened surface similar to the adjusting screw 30 to allow the fingers to turn the screw instead of a hex screw used in the previous invention which would require a screw driver. The turning of the screw 43 narrows or widens the distance between the pickup and the pickup holder.

Figure 5A:
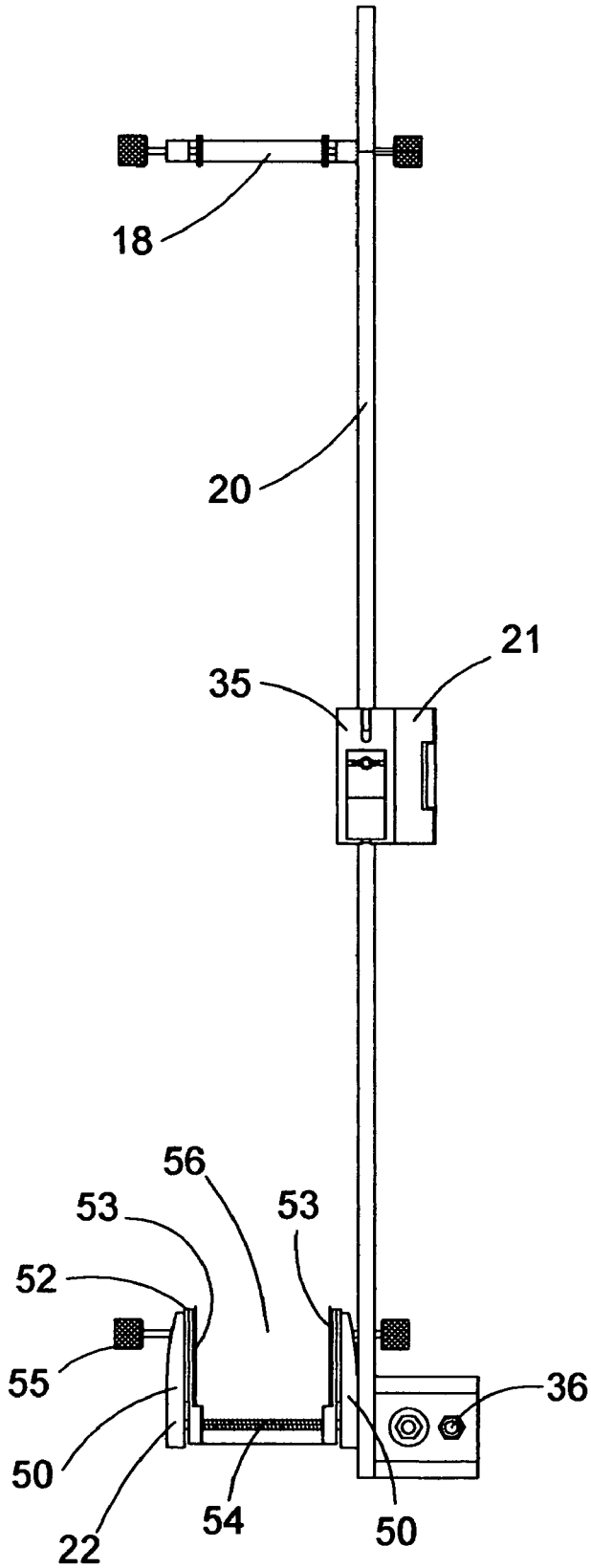
FIG. 5A is a left side view of a detachable top pickup assembly showing a side view of the bottom clamp for holding a mid bottom section of the guitar and the top clamp for holding a top side section of the guitar.
Figure 5B:
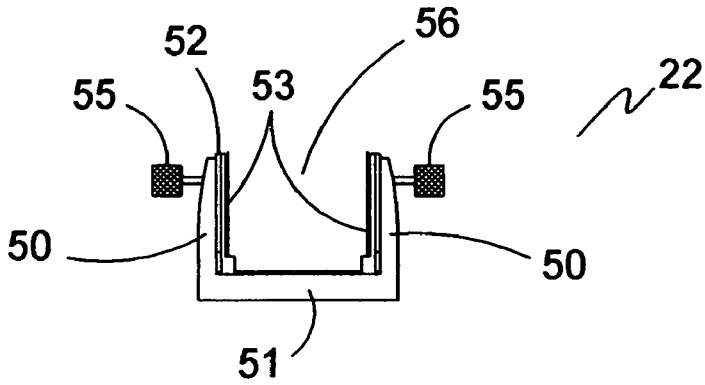
FIG. 5B is a right side view of the bottom clamp.
Figure 5:
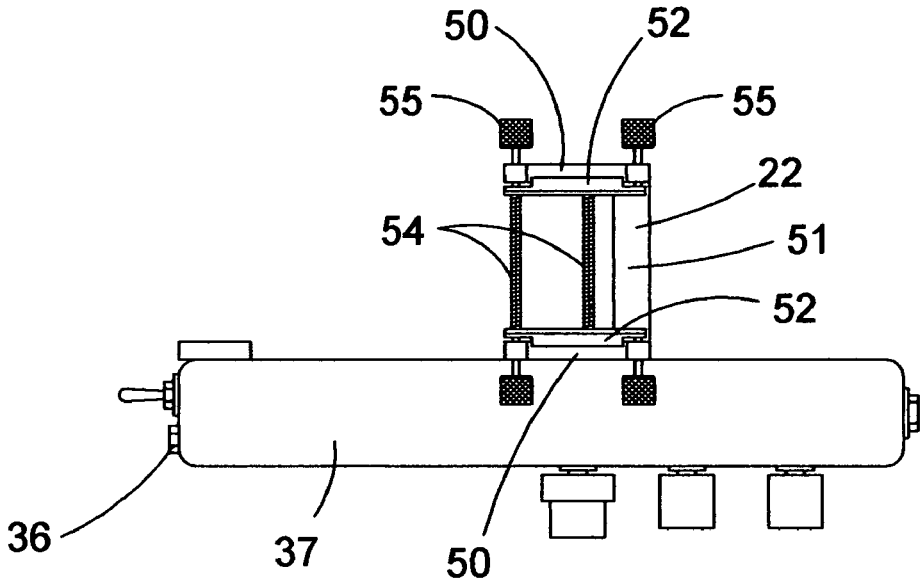
FIG. 5 is a top view of the bottom clamp attached at the rear of the control box for the guitar.

It is recommended to connect an elongated strip at the bottom end of the bar 20 to hold the second C-clamp 22 also referred to as the bottom clamp. In the example shown in FIG. 3A, here, the control box 37 is used as a substitute to the elongated strip. In FIG. 5 the second C-clamp 22 is attached to the rear of the control box 37. The use of a control box instead of a plain elongated strip offers the advantage of hiding the connectors used in connecting the C-clamp 22 inside the control box. This is the same with the connectors used to connect the control box to the bar 20. Connectors are known in the art such as screws, nuts and bolts, strong adhesives and the like. FIG. 5 shows the top view of the C-clamp 22 while FIG. 5A shows the left side view of the C-clamp 22. C-clamp 22 is modified in its construction compared to the C-clamp 18. Like the C-clamp 18, however, other clamps that can function similarly as the C-clamp can be used. The outside borders for the C-clamp 22 illustrated here as example are a pair of exterior plates 50, joined by a bar 51 at one common lateral bottom end of the plates to form the C shape as shown by FIGS. 5A and SB. As in C-clamp 18, within the exterior or outside plates 50, there are also a pair of inside plates 52 both having a lining 53 made of scratch preventing material at the surface facing the interior of the C-clamp 22 to prevent scratching the surface of a mid bottom section of a guitar that would be held by the clamp. The pair of inside plates 52 is also separated by a spring enveloped bar 54 connected to the exterior plates 50. Here, there are at least two bars 54 because the exterior and inside plates are wider than the outside border and inside strips of C-clamp 18. Likewise, as shown in FIG. 5, there are also two pairs of adjusting screws 55 instead of one. The mid bottom section of the body of the guitar is introduced into the open end 56 of the C-clamp 22. The edges of the bottom section should not touch the spring enveloped bars aligned with the bar 51 at the bottom end of the C-clamp to prevent scratching the bottom surface. Like the C-clamp 18, the width of the open end 56 and consequently the distance between the pair of outside plates 50 is also a little wider than the thickness of an ordinary guitar. It is the inside plates that abut the surfaces of the bottom body of the guitar through the pairs of adjusting screws 55. The inside plates 52, like the inside strips 27, also positions the guitar and consequently the distance between the top pickup and the strings. The positioning of the inside strips 27 and the inside plates 52, must be synchronized and coordinated to avoid any strain or stress on the guitar as well as achieve the desired distance between the top pickup and the strings especially when the strings are in an inclined position instead of flat. The function of the spring enveloped bars for C-clamp 22 is the same as its function for C-clamp 18 and will not be reiterated.

FIG. 3A shows the relative position of the two C-clamps to each other. The bottom C-clamp is farther from the bar 20 because of the distance of the mid bottom section of the body of the guitar relative to the top side section of the body of the guitar. These positions on the body of the guitar were chosen because it will provide a stable hold on the top pick up assembly as well as position the top pickup 21 on top of the strings 12. The open end 24 and 56 of the two clamps as well as the length of the respective lateral sides of the outside borders 26 and bar 51 allows flexibility in positioning the guitar in case the distance between the top side section to be clamped and the mid bottom section of the guitar varies for different types of guitars. It is also possible for the open end 24 of the top C-clamp to face the neck of the guitar instead of away from the neck as illustrated here. Where the C-clamp faces may affect the applicability of the top pickup assembly depending upon the differences in the distances between the top side section and the mid bottom section of the guitar. The connector of the top C-clamp 18 should be one that will allow the C-clamp to face either way. Also in the illustration presented, the top pickup assembly 100 is clamped on the left side to avoid getting into the way of the control knobs and connectors at the right side front panel of the guitar. Obviously, these can exchange places, if desired. Adjustments can also be made for left handed players. What is important here is to have at least a clamp that would stably attach the top pickup assembly and allow the top pickup to travel on top of and along a workable length of the string/s. The guitar can have or not have a bottom pickup. The top pickup assembly can be made of metal or plastic. Use of plastic materials provide the advantage of lightening the weight of the top pickup assembly. Use of strong adhesives are also more suited on plastic materials instead of metals.

The use of the term "connect", "attach", "mount", "install" include direct or indirect connections with or without intervening or intermediary devices or other means that can couple or attach or fix the parts together or the parts with other components or sections of the guitar.

While the embodiments of the present invention have been described, it should be understood that various changes, adaptations, and modifications may be made therein without departing from the spirit of the invention and the scope of the claims.

I claim:

1. A detachable and portable top pickup including a pick up holder for a musical stringed instrument, comprising:

a top clamp for holding a top section of the musical stringed instrument;

a bottom clamp for holding a bottom section of the musical stringed instrument;

an elongated bar parallel in position with a string of the musical stringed instrument having a top end connecting to the top clamp and a bottom end connecting to the bottom clamp;

a connector coupling the top pickup to the elongated bar, the connector allowing the top pickup to slide along a length of the elongated bar between the top clamp and the bottom clamp and allowing the top pickup to slide on top of and along a length of the string; and, means for attaching the top and bottom clamps and the connector to the elongated bar.

2. The detachable pickup of claim 1 wherein the the bottom clamp comprises a pair of exterior plates joined by a bar at one common lateral bottom end of the plates to form a C shape; a pair of inside plates separated by two spring enveloped bars connected to the exterior plates at an interior section of the clamp, the pair of inside plates lined on the surface facing the interior of the clamp with a scratch preventing material; and, two pairs of adjusting screws for pushing the pair of inside plates towards a surface of the guitar.

3. The detachable top pickup of claim 2 wherein the open end of the clamp is wider than the thickness of an ordinary musical stringed instrument.

4. The detachable top pickup of claim 1 wherein the top clamp comprises a pair of outside borders connected to a bottom closed end forming a shape of a C; a pair of inside strips separated by a spring enveloped bar at an interior section of the clamp, the pair of inside strips lined on the surface facing the interior of the clamp with a scratch preventing material; and, a pair of adjusting screws for pushing the pair of inside strips towards a surface of the musical stringed instrument.

5. The detachable top pickup of claim 4 wherein the adjusting screw has a head with a roughened surface at one end and another end opposite the head abutting a surface of the inside strip facing the outside border.

6. The detachable top pickup of claim 1 wherein the open end of the top clamp is wider than the thickness of an ordinary musical stringed instrument.

7. The detachable top pickup of claim 1 wherein the elongated bar is solid or hollow.

8. The detachable top pickup of claim 1 wherein the connector has a locking mechanism for restraining and releasing the top pickup.

9. The detachable top pickup of claim 8 wherein the locking mechanism has a trigger for easily releasing the top pickup and changing the position of the top pickup along the elongated bar.

10. The detachable top pickup of claim 1 wherein the connector has a flip holder allowing the top pickup to be raised in a vertical position through a hinge and placed on either side of the elongated bar through a pivot pin, thereby placing the top pickup away from a zone of string vibration.

11. The detachable top pickup of claim 1 wherein a pivot pin attaches the top pickup to the connector.

12. The detachable pickup of claim 11 wherein the pivot pin allows the top pickup to swing into, partially into or out of a zone of string vibration.

13. The detachable pickup of claim 11 wherein the pivot pin allows the top pickup to swing over approximately a hundred eighty degree span on a vertical or horizontal position.

14. The detachable pickup of claim 1 wherein a distance is kept between the top pickup and the pickup holder by a spring enveloped screw having the spring enveloping only that portion of the screw between the top pickup and the pickup holder.

15. The detachable pickup of claim 14 wherein the spring enveloped screw narrows or widens the distance between the top pickup and the pickup holder and adjusts the distance between the string and the top pickup.

16. The detachable pickup of claim 1 wherein the detachable and portable pickup is made of metal or plastic.

17. A detachable and portable top pickup having a pickup holder for a guitar, comprising:

a first clamp having an open end for holding a section of a guitar;

a second clamp having an open end for attaching the top pickup to a different section of the guitar;

an elongated bar parallel in position with a string of the musical stringed instrument having a top end connecting to the first clamp and a bottom end connecting to the second clamp;

a connector coupling the top pickup to the elongated bar, the connector allowing the top pickup to slide along a length of the elongated bar between the first clamp and the second clamp and allowing the top pickup to slide on top of and along a length of the string; and, means for attaching the clamps and the connector to the elongated bar.

18. The detachable top pickup of claim 17 wherein the connector has a locking mechanism for restraining and releasing the top pickup and a flip holder allowing the top pickup to be raised in a vertical position through a hinge and placed on either side of the elongated bar through a pivot pin, thereby placing the top pickup away from a zone of string vibration.

19. The detachable top pickup of claim 17 wherein a pivot pin attaches the top pickup to the connector, the pivot pin allowing the top pickup to swing into, partially into or out of a zone of string vibration in a horizontal position and to swing over approximately a hundred eighty degree span on a vertical position.

20. The detachable top pickup of claim 17 wherein the first clamp holds a top section of the guitar and the second clamp attaches to a rear mid section of a control box having one end connecting to the elongated bar, the second clamp holding a mid bottom section of the guitar.

* * * * *